US011420835B2

(12) United States Patent
Sato et al.

(10) Patent No.: US 11,420,835 B2
(45) Date of Patent: Aug. 23, 2022

(54) SHEET STORAGE DEVICE AND IMAGE FORMING APPARATUS

(71) Applicant: CANON KABUSHIKI KAISHA, Tokyo (JP)

(72) Inventors: Masaki Sato, Kawasaki (JP); Shinta Cho, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 145 days.

(21) Appl. No.: 16/352,573

(22) Filed: Mar. 13, 2019

(65) Prior Publication Data

US 2019/0300304 A1 Oct. 3, 2019

(30) Foreign Application Priority Data

Mar. 30, 2018 (JP) ..... JP2018-068253
Oct. 30, 2018 (JP) ..... JP2018-204524

(51) Int. Cl.
*B65H 1/26* (2006.01)
*G03G 15/00* (2006.01)

(52) U.S. Cl.
CPC ..... *B65H 1/266* (2013.01); *G03G 15/6529* (2013.01); *B65H 2403/411* (2013.01); *B65H 2405/114* (2013.01); *B65H 2511/10* (2013.01); *B65H 2511/12* (2013.01)

(58) Field of Classification Search
CPC . B65H 1/00; B65H 1/04; B65H 1/266; B65H 2403/41; B65H 2403/411; B65H 2405/114; B65H 2405/11425; B65H 2405/1144; B65H 2405/121; B65H 2405/31; B65H 2511/00; B65H 2511/10; B65H 2511/12
See application file for complete search history.

(56) References Cited

U.S. PATENT DOCUMENTS 5,611,528 A * 3/1997 Nakamura ..... B65H 1/266 271/171
6,014,229 A * 1/2000 Yun ..... H04N 1/0071 358/488

(Continued)

FOREIGN PATENT DOCUMENTS

JP 2003-081451 A 3/2003
JP 2007-191269 A 8/2007

(Continued)

*Primary Examiner* — Prasad V Gokhale
(74) *Attorney, Agent, or Firm* — Canon U.S.A., Inc. I.P. Division

(57) ABSTRACT

A sheet storage device for storing sheets includes a supporting unit, a regulation unit, and a moving unit. The supporting unit supports stored sheets. The regulation unit is movably arranged on the supporting unit, and regulates a position of an edge portion of a sheet. The moving unit moves the regulation unit. The moving unit includes moving members to move in a direction parallel to a moving direction of the regulation unit. The moving members are moved by rotation of a rotation member in a case where the rotation member is in contact with the moving members. In a case where a fixing member attached to the sheet storage device in place of the rotation member, movement of the moving members is regulated by placing the moving members into contact with the fixing member.

12 Claims, 12 Drawing Sheets

(56) References Cited

U.S. PATENT DOCUMENTS

| | | | | |
|---|---|---|---|---|
| 8,020,854 | B2 * | 9/2011 | Hayakawa | B65H 1/04 271/144 |
| 2013/0193636 | A1 * | 8/2013 | Udagawa | B65H 1/00 271/162 |

FOREIGN PATENT DOCUMENTS

| | | | |
|---|---|---|---|
| JP | 2014-196169 | A | 10/2014 |
| JP | 2016113300 | A | 6/2016 |

* cited by examiner

SHEET STORAGE DEVICE AND IMAGE FORMING APPARATUS

BACKGROUND OF THE INVENTION

Field of the Invention

The present disclosure relates to a sheet storage device and an image forming apparatus.

Description of the Related Art

A sheet storage device used for an image forming apparatus main body can store various sizes of sheets and regulate a position of sheets stacked on a stacking unit included in the sheet storage device.

A cassette unit attachable to and detachable from a main body of an image forming apparatus is known as one example of the sheet storage device. The cassette unit includes a regulation unit which regulates a position in a conveyance direction or a width direction of the sheets stacked on the stacking unit. A role of the regulation unit is to correctly regulate the position of the sheets stacked on the stacking unit to achieve an appropriate sheet conveyance operation. Since the sheets stacked on the stacking unit have a wide variety of sizes, the regulation unit needs to move depending on the sheet size.

The regulation unit includes an operation lever operated by a user or a serviceperson. By operating the operation lever, the user can release a fixed state of the regulation unit and move the regulation unit. Further, when the user stops operating the operation lever, the regulation unit is fixed to a position where the operation of the operation lever is stopped.

Japanese Patent Application Laid-Open No. 2016-113300 discusses a configuration in which an operation lever is arranged on the upper side of a regulation unit, which allows a user to easily recognize or operate the operation lever.

The regulation unit described in Japanese Patent Application Laid-Open No. 2016-113300 is moved by operating the operation lever.

Depending on the user, in order to use only regular size sheets, there are cases where the regulating unit is fixed. In some cases, the regulating unit is fixed so that the regulating unit does not move during transportation of the image forming apparatus.

SUMMARY OF THE INVENTION

According to an aspect of the present disclosure, a sheet storage device for storing sheets includes a supporting unit configured to support stored sheets, a regulation unit movably arranged on the supporting unit, and configured to regulate a position of an edge portion of a sheet, and a moving unit configured to move the regulation unit, wherein the moving unit includes moving members configured to move in a direction parallel to a moving direction of the regulation unit, wherein the moving members are moved by rotation of a rotation member in a case where the rotation member is in contact with the moving members, and wherein, in a case where a fixing member is attached to the sheet storage device in place of the rotation member, movement of the moving members is regulated by placing the moving members into contact with the fixing member.

Further features of the present disclosure will become apparent from the following description of embodiments with reference to the attached drawings.

DESCRIPTION OF THE EMBODIMENTS

A first embodiment of the present disclosure will be described below with reference to the drawings. However, sizes, materials, shapes, and relative positions of constituent elements described in the present embodiment should be changed as appropriate according to the configuration or various conditions of the apparatus to which the present disclosure is applied. Thus, the scope of the present disclosure should not be limited to the below-described embodiment.

Figure 1:
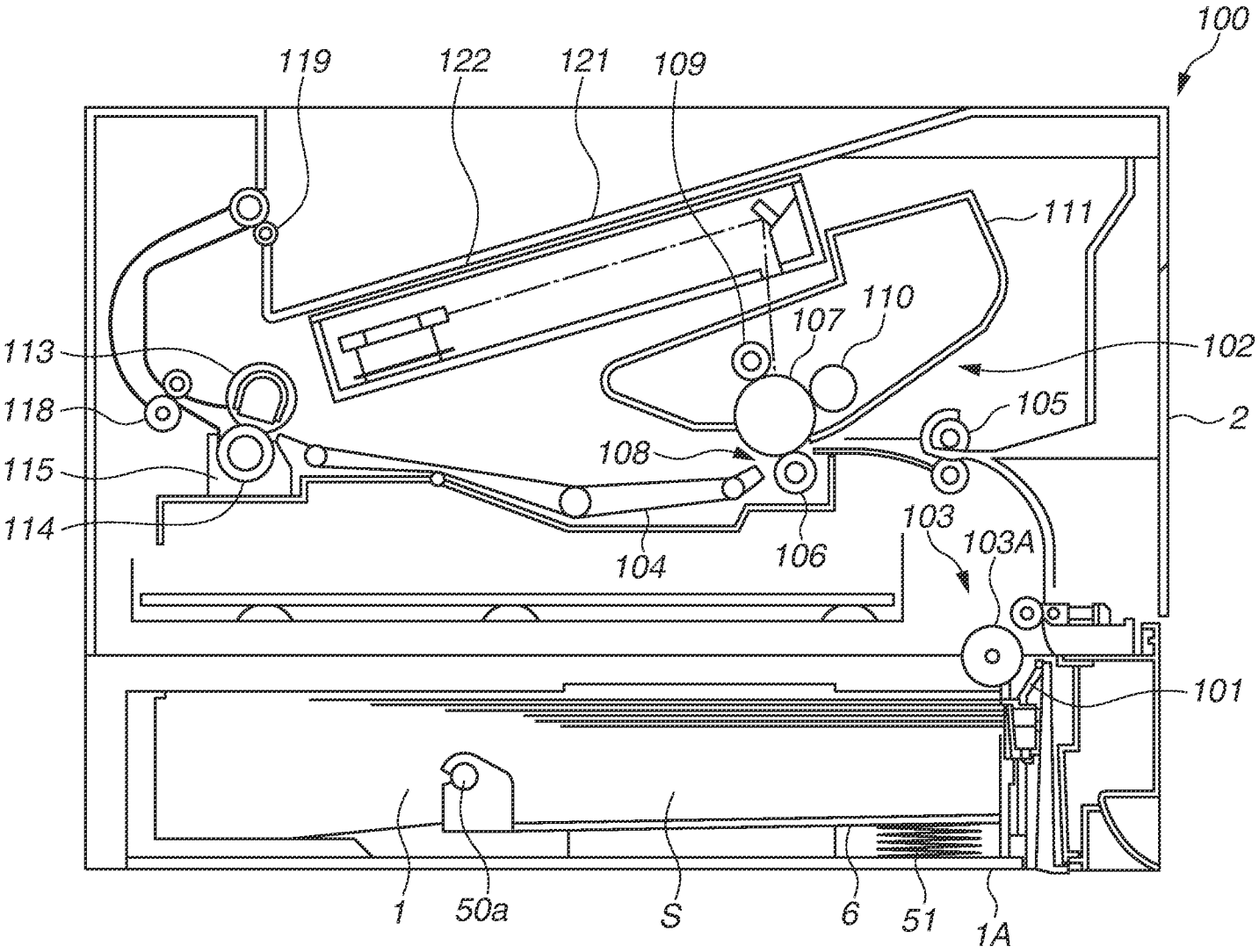
FIG. 1 is a cross-sectional diagram illustrating a configuration of an image forming apparatus.

FIG. 1 is a cross-sectional diagram illustrating a configuration of a color electrophotographic type image forming apparatus 100. The present disclosure is not limited to the image forming apparatus 100 employing the electrophotographic processing. The present disclosure is also applicable to an age forming apparatus of another type, e.g., a printer employing ink-jet image forming processing.

As illustrated in FIG. 1, the image forming apparatus 100 includes an apparatus main body 2, an image forming unit 102 that forms an image through an electrophotographic method, and a sheet feeding device 103 that feeds a sheet S to the image forming unit 102.

The image forming unit 102 includes a photosensitive drum 107 for forming a toner image, a charging roller 109 for uniformly charging a surface of the photosensitive drum 107, and a development unit 110 for supplying toner to the photosensitive drum 107.

The sheet feeding device 103 includes a cassette 1 serving as a sheet storage device, which is capable of storing a plurality of sheets S, and a feeding roller 103A serving as a feeding member, which is arranged on the upper side of the cassette 1 and feeds the sheets S stored in the cassette 1.

The cassette 1 includes a cassette main body 1A for storing the sheets S and a stacking member. An intermediate plate 6 serving as the stacking member, on which the sheets S are stacked, is held in a freely rotatable state in the upper and lower directions without meaningful restriction by making a shaft 50*a* included in the cassette main body 1A as a supporting point and biased to the feeding roller 103A by a coil spring 51. The intermediate plate 6 stacks a plurality of sheets S.

The cassette main body 1A includes a supporting unit for supporting the sheets S, and includes a bottom face portion that constitutes an exterior face of the cassette main body 1A. The intermediate plate 6 serving as the stacking member is pushed up by the coil spring 51 in a direction of the feeding roller 103A, so that the sheets S stacked on the intermediate plate 6 is pressed against the feeding roller 103A. Further, in this cassette 1, a separation unit 101 for separating the sheets S fed by the feeding roller 103A one by one is provided.

Next, an image forming operation performed by the image forming apparatus 100 will be described. First, based on an image signal from a host computer (not illustrated), a laser scanner 122 serving as an exposure unit emits laser light on the photosensitive drum 107. A surface of the photosensitive drum 107 is previously charged by the charging roller 109 in advance, and the photosensitive drum 107 rotates in a clockwise direction. With this configuration, an electrostatic latent image is formed on the surface of the photosensitive drum 107. The electrostatic latent image formed on the surface of the photosensitive drum 107 is developed with toner on the development unit 110, and thus a toner image is formed on the photosensitive drum 107.

On the other hand, the feeding roller 103A starts rotating at a predetermined timing, and the intermediate plate 6 biased to a side of the feeding roller 103A by the coil spring 51 is rotationally moved upward interlocking with the rotation of the feeding roller 103A. Accordingly, a leading edge portion of the sheet S stacked on the intermediate plate 6 is pressed to contact the feeding roller 103A with a predetermined force. At this time, the feeding roller 103A is controlled to rotate in a counter-clockwise direction only when the sheet S is fed thereby, and the sheet S in a press-contact state is fed by a frictional force. If a plurality of sheets S stacked on the intermediate plate 6 is fed simultaneously, only an uppermost sheet of the sheets S is separated and conveyed downstream by the separation unit 101.

The uppermost sheet S separated by the separation unit 101 is conveyed to a skew correction unit 105, and skew correction is executed thereon. Thereafter, the sheet S is conveyed to a transfer portion 108 consisting of the photosensitive drum 107 and a transfer roller 106 by the skew correction unit 105. As described above, a toner image formed on the photosensitive drum 107 is electrically attracted and transferred to the sheet S by the transfer roller 106.

The sheet S on which the toner image is transferred is conveyed to a fixing unit 115 configured of a heating unit 113 and a pressure roller 114 by a conveyance belt 104, and heat and pressure are applied thereto at the fixing unit 115 and thus, the toner image is fixed to the sheet S. Then, the sheet S is discharged, by an intermediate discharge roller pair 118 and a discharge roller pair 119, onto a sheet discharge tray 121 arranged on the upper face of the apparatus main body 2.

Figure 2A:
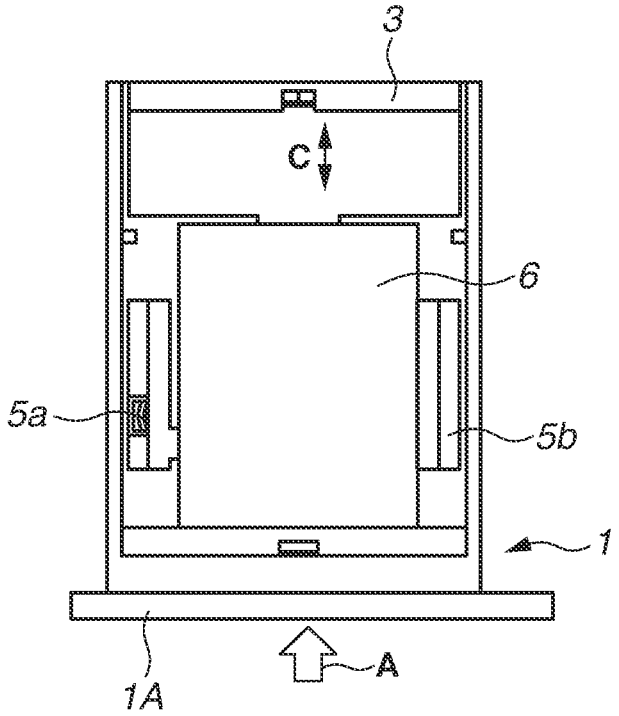
FIG. 2A is a top plan diagram of a cassette detached from an apparatus main body.
Figure 2B:
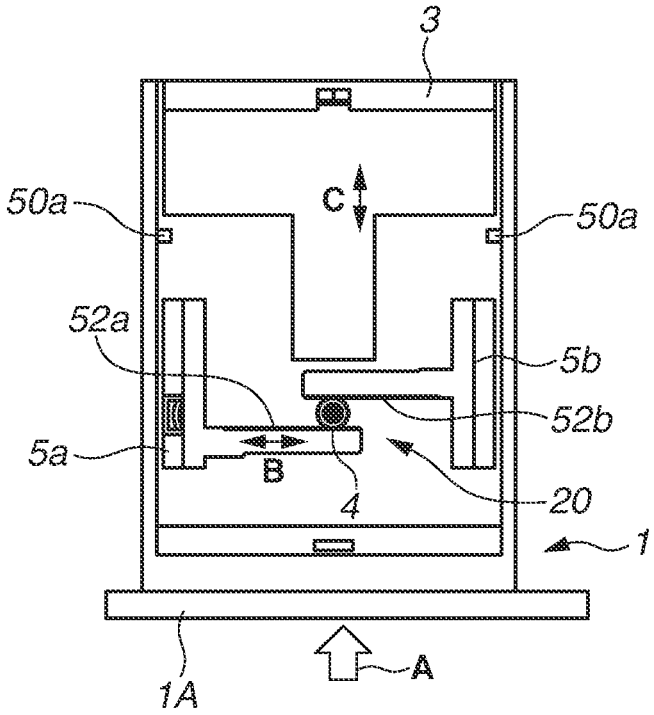
FIG. 2B is a top plan diagram of the cassette illustrated in FIG. 2A, from which an intermediate plate is removed.

Next, a configuration of the cassette 1 will be described with reference to FIGS. 2A and 2B. FIG. 2A is a top plan diagram of the cassette 1 removed from the apparatus main body 2. FIG. 2B is a top plan diagram of the cassette 1 illustrated in FIG. 2A, from which the intermediate plate 6 is removed. A configuration of a cassette main body will be described with reference to FIGS. 2A and 2B. FIGS. 2A and 2B are diagrams illustrating an inner portion of the cassette 1. In a state where the cassette 1 is attached to the apparatus main body 2, an arrow-A direction of the cassette 1 is the sheet conveyance direction.

The cassette 1 includes a cassette main body 1A for storing sheets of various sizes, regulation units 5*a*, 5*b*, and 3 for regulating positions of edge portions of the sheets S supported by the cassette main body 1A, and the intermediate plate 6. The regulation unit includes a rear-edge regulation member 3 and width regulation members 5*a* and 5*b*. The rear-edge regulation member 3 abuts on the rear edge of the sheet in the sheet conveyance direction to regulate a position of the rear edge. The width regulation members 5*a* and 5*b* regulate a position of the sheet in the width direction intersecting with the sheet conveyance direction. The width regulation members 5*a* and 5*b* and the rear-edge regulation member 3 are arranged so as not to have an influence on rotational movement of the intermediate plate 6 illustrated in FIG. 1.

In the present embodiment, because a sheet feeding apparatus and an image forming apparatus are integrally configured as the image forming apparatus 100, the cassette 1 is attachable to and detachable from the image forming apparatus 100. However, in a configuration in which the sheet feeding apparatus is arranged independently from the image forming apparatus, the cassette 1 is attachable to and detachable from the sheet feeding apparatus. Conventionally, an option feeder attachable to the image forming apparatus 100 is an example of a sheet feeding apparatus.

When a plurality of sheets S is to be stored in the cassette 1, the side edge positions of the sheets S are regulated by making the width regulation members 5*a* and 5*b* abut on the side edges of the sheets 5, whereas the rear edge positions of the sheets S are regulated by making the rear-edge regulation member 3 abut on the rear edges of the sheets S after the sheets S are placed on the intermediate plate 6. Thus, the sheets S are positioned and stored therein. Next, the cassette 1 is attached to the image forming apparatus 100, and the sheets S are fed one by one by the feeding roller 103A.

When the cassette 1 is attached thereto, the intermediate plate 6 illustrated in FIG. 1 is pushed upward by the coil spring 51 illustrated in FIG. 1 by making the shaft 50*a* as a center. With this configuration, the sheets S positioned by the width regulation members 5*a* and 5*b* and the rear-edge regulation member 3 are pressed against the feeding roller 103A illustrated in FIG. 1. The sheets S pressed against the feeding roller 103A are fed by the feeding function of the feeding roller 103A one by one, and fed to the image forming unit 102 illustrated in FIG. 1.

A moving unit 20 that moves the width regulation members 5*a* and 5*b* in the width direction is arranged on the cassette main body 1A. The moving unit 20 includes rack portions 52*a* and 52*b* serving as moving members movable in a direction parallel to the moving direction of the width regulation members 5*a* and 5*b* and a pinion gear 4 serving as a rotation member. Specifically, the rack portions 52*a* and 52*b*, which extend in an arrow-B direction, i.e., a direction the same as the width direction or the moving direction of the width regulation members 5*a* and 5*b*, are respectively arranged at the lower portions of the width regulation members 5*a* and 5*b* as a pair as illustrated in FIG. 2B. The rack portions 52*a* and 52*b* are guided by guide grooves (not illustrated) provided on the bottom plate of the cassette main body 1A in the arrow-B direction and freely movable without meaningful restriction in the width direction. Further, the rack portions 52*a* and 52*b* includes rack gears that engage with the rotatable pinion gear 4.

The pinion gear 4 serving as a rotation member, which is freely rotatable about a shaft portion without meaningful restriction, is arranged at the center of the bottom face portion of the cassette main body 1A. The pinion gear 4 has a gear shape, and is attachable to and detachable from the cassette main body 1A. The teeth formed on the rack portions 52*a* and 52*b* engage with the pinion gear 4. With this configuration, because of the function of the pinion gear 4 and the rack portions 52*a* and 52*b*, when one of the width regulation members 5*a* and 5*b* moves in the width direction (i.e., first direction), the other of the width regulation members 5*a* and 5*b* cooperatively moves in a direction (i.e., second direction) opposite to the direction of the one of the width regulation members 5*a* and 5*b*. As described above, both of the width regulation members 5*a* and 5*b* simultaneously move in the width direction to abut on the side edges of the sheets stacked on the intermediate plate 6 by moving one of the width regulation members 5*a* and 5*b*, so that positioning of the sheets in the width direction can be executed easily.

The rear-edge regulation member 3 is guided by a guide groove (not illustrated) provided on the bottom plate of the cassette main body 1A in an arrow-C direction, and freely movable without meaningful restriction in the sheet feeding direction. As described above, the width regulation members 5*a* and 5*b* can freely move without meaningful restriction depending on a size of stacked sheets.

As described above, a user may fix the width regulation members 5*a* and 5*b* because the user uses only a sheet of a predetermined standard size. Further, there is a case where the width regulation members 5*a* and 5*b* are fixed at the time of transportation of the image forming apparatus 100. In the present embodiment, the width regulation members 5*a* and 5*b* are fixed with a simple configuration by utilizing the moving unit 20.

Figure 3A:
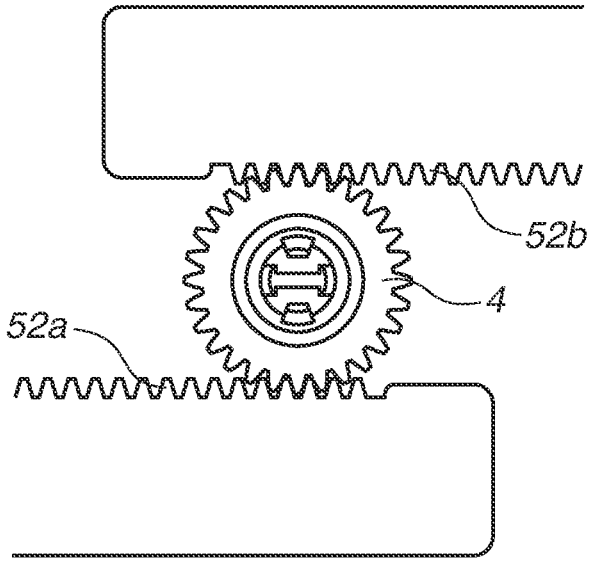
FIG. 3A is an enlarged diagram illustrating a periphery of a rotation member illustrated in FIG. 2B.
Figure 3B:
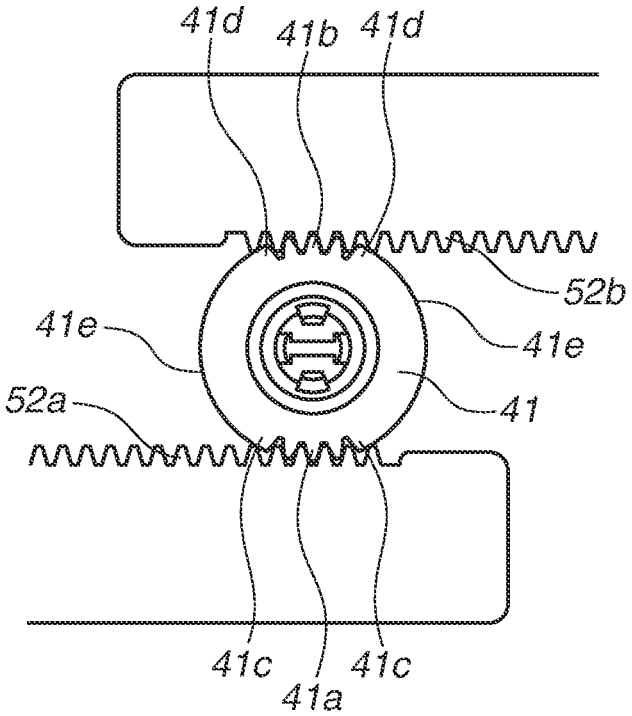
FIG. 3B is an enlarged diagram illustrating a state where a first fixing member is attached to the cassette in place of the rotation member illustrated in FIG. 3A.

FIG. 3A is an enlarged diagram illustrating a periphery of the pinion gear 4 illustrated in FIG. 2B. FIG. 3B is an enlarged diagram illustrating a state where a first fixing member 41 is attached to the cassette main body 1A in place of the pinion gear 4. A method of attaching the first fixing member 41 will be described below. First, the intermediate plate 6 illustrated in FIG. 1 is removed from the cassette 1. Next, the width regulation members 5*a* and 5*b* are moved to a desired or predetermined position. The pinion gear 4 is removed in a state where the width regulation members 5*a* and 5*b* are positioned. Positioning of the width regulation members 5*a* and 5*b* may be executed before the intermediate plate 6 is removed. In this case, standard size sheets are set in the cassette 1, and positioning of the width regulation members 5*a* and 5*b* may be executed by abutting the width regulation members 5*a* and 5*b* on the sheets.

Next, the stopper 41 serving as the first fixing member illustrated in FIG. 3B is attached to a position where the pinion gear 4 has been attached. Lastly, the intermediate plate 6 is attached. As described above, teeth 41*a* of the stopper 41 engage with the rack portion 52*a*, whereas teeth 41*b* of the stopper 41 similarly engage with the rack portion 52*b* on the opposite side. Then, outer edge portions 41*c* of the non-engaging portion of the stopper 41 are in contact with the rack portion 52*a*. Similarly, outer edge portions 41*d* of the non-engaging portion of the stopper 41 on the opposite side are in contact with the rack portion 52*b* facing thereto. And thus, movement of the rack portions 52*a* and 52*b* is restricted and movement of the width regulation member 5*a* and 5*b* are fixed.

Figure 4A:
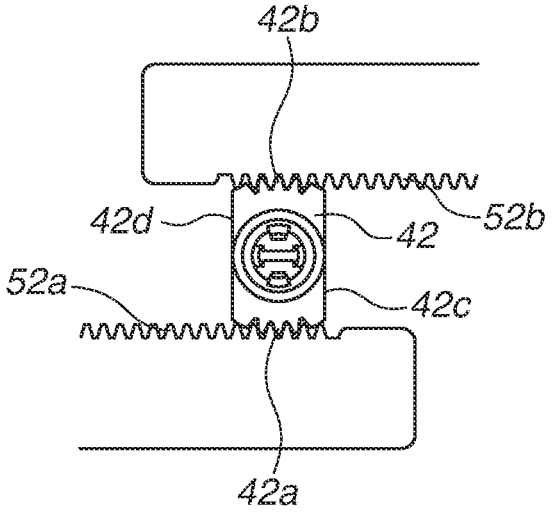
FIGS. 4A, 4B, and 4C are enlarged diagrams illustrating other fixing members.
Figure 4B:
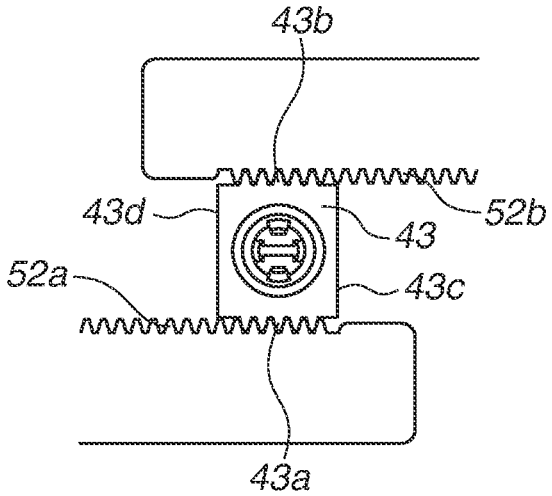

As described above, although the stopper 41 includes the arc-shaped outer edge portion 41*d* as a non-engaging portion, the stopper 41 may be formed into another shape. For example, the first fixing members having the shapes illustrated in FIGS. 4A to 4C may be also used. FIG. 4A is a cross-sectional diagram illustrating a stopper 42 and linear-shaped portions 42*c* and 42*d* of the stopper 12. FIG. 4B is a cross-sectional diagram illustrating a stopper 43 and linear-shaped portions 43*c* and 43*d* of the stopper 43. Teeth 42*a* and 42*b* of the engaging portion of the stopper 42 are arranged linearly, and the linear-shaped portions 42*c* and 42*d* without having teeth serve as the non-engaging portions. Similarly, teeth 43*a* and 43*b* of the engaging portion of the stopper 43 are arranged linearly, and the linear-shaped portions 43*c* and 43*d* without having teeth serve as the non-engaging portions. Because the teeth of the engaging portion are arranged linearly, rattling arising in the fixed width regulation members 5*a* and 5*b* will be less in comparison to the case of the arc-shaped stopper. On the other hand, for example, if a phase of the rack portions 52*a* and 52*b* becomes different in Letter size and A4 size, stoppers adjusted to different phases will be needed as illustrated in FIGS. 4A and 4B.

Figure 4C:
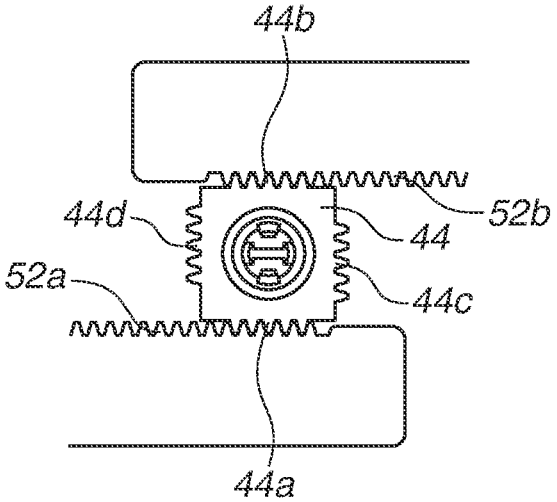

Further, as illustrated in FIG. 4C, teeth 44*a* and 44*b* are linearly arranged on the engaging portion of the stopper 44 similarly with the teeth 43*a* and 43*b* illustrated in FIG. 4B, and teeth 44*c* and 44*d* are also arranged on non-engaging portions. For example, the teeth 44*a* and 44*b* are arranged on the engaging portions dedicated for Letter size, whereas the teeth 44*c* and 44*d* are arranged on the engaging portions dedicated for A4 size. Then, the phase of the teeth dedicated for Letter size is shifted from the phase of the teeth dedicated for A4 size, so that a single stopper can manage a situation in which the phases of the rack portions 52*a* and 52*b* for Letter size and A4 size are different.

Further, a front face of the stopper may be formed into a shape of the pinion gear 4 as illustrated in FIG. 3A, whereas a back face thereof may be formed into a shape as illustrated in FIG. 3B. With this configuration, the pinion gear 4 and the stopper 41, 42, or 43 are formed of a single component. Thus, fixation or non-fixation of the width regulation members 5*a* and 5*b* are managed with a single component by attaching the component thereto with a front and a back faces thereof being inverted.

Further, a housing portion dedicated for housing the stopper 41 (or stopper 42 or 43) may be provided on the cassette main body 1A. In this case, the pinion gear 4 is attached to the cassette main body 1A, and the stopper 41 is taken out from the housing portion and used when the width regulation members 5*a* and 5*b* are fixed.

As described above, in the present embodiment, the width regulation members 5*a* and 5*b* are fixed by utilizing the constituent elements included in the moving unit 20. Therefore, screw holes dedicated for fixing the width regulation members 5*a* and 5*b* do not have to be provided on the cassette main body 1A. Further, the stopper 41 (or stopper 42 or 43) cannot be detached easily because the stopper 41 is thoroughly covered by the intermediate plate 6 in a manner that is thorough or complete.

According to the configuration described in the first embodiment, the stopper 41 serving as the first fixing member is attached to the central portion of the bottom face of the cassette main body 1A in place of the pinion gear 4, and the width regulation members 5*a* and 5*b* are fixed thereby. According to the configuration described in the second embodiment, the width regulation members 5*a* and 5*b* are fixed without removing the pinion gear 4 from the cassette main body 1A. A reference numeral the same as that of the first embodiment will be applied to the configuration similar to the configuration described in the first embodiment.

Figure 5A:
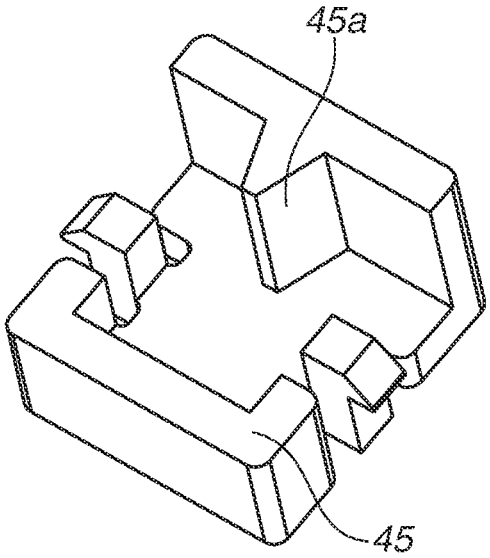
FIG. 5A is a perspective view illustrating a second fixing member.
Figure 5B:
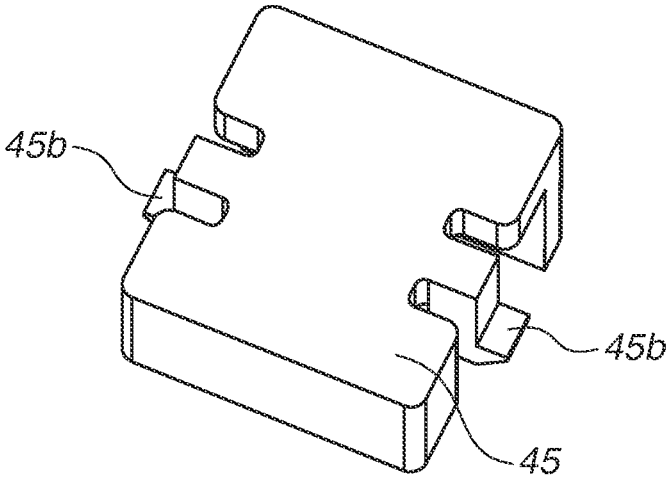
FIG. 5B is a perspective view illustrating a back face side of the second fixing member.
Figure 6A:
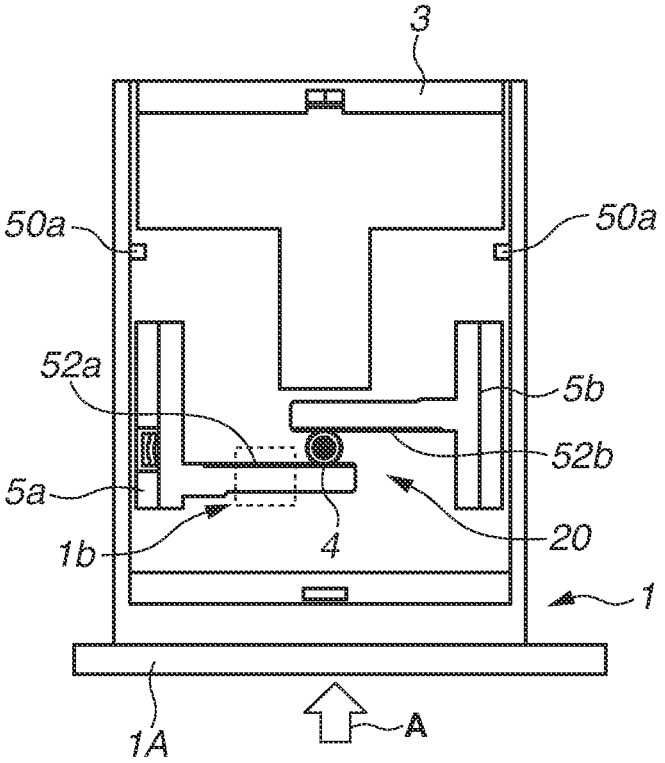
FIG. 6A is a top plan diagram of the supporting unit detached from the apparatus main body, and from which the intermediate plate is further removed.
Figure 6B:
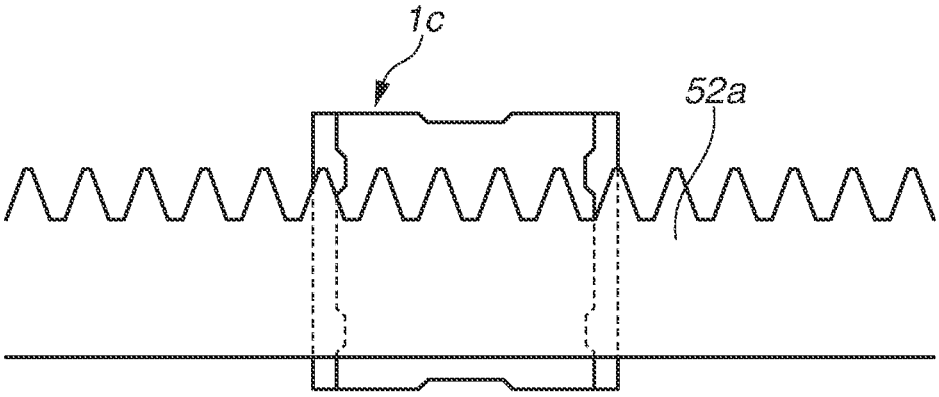
FIG. 6B is a partially enlarged diagram illustrating a peripheral area of an opening of the supporting unit.

FIGS. 5A and 5B are perspective views illustrating a stopper 45 as the second fixing member. Further, FIG. 6A is a top plan diagram of the cassette main body 1A detached from the apparatus main body, from which the intermediate plate 6 is further removed. FIG. 6B is a partially enlarged diagram illustrating a peripheral area 1*b* of a hole 1*c* of the cassette main body 1A illustrated in FIG. 6A. The hole 1*c* of the cassette main body 1A will be described below.

Figure 7A:
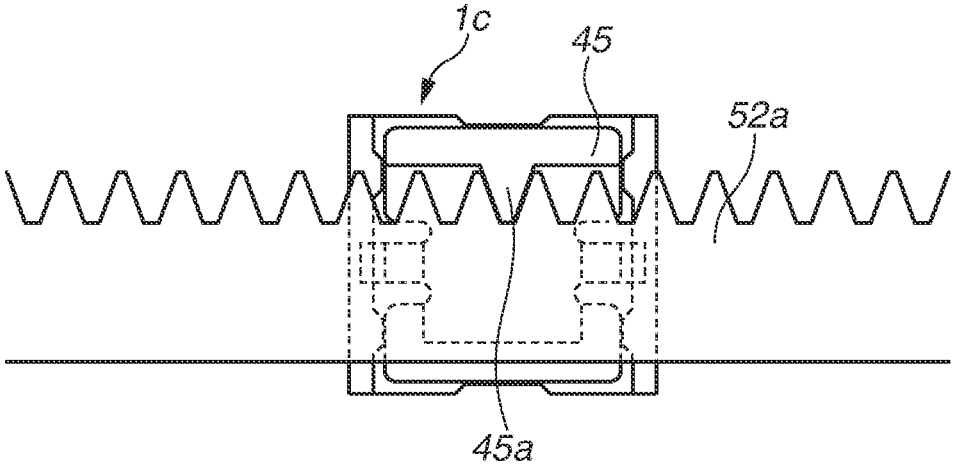
FIG. 7A is a partially enlarged diagram illustrating a state where the second fixing member is attached to the supporting unit.
Figure 7B:
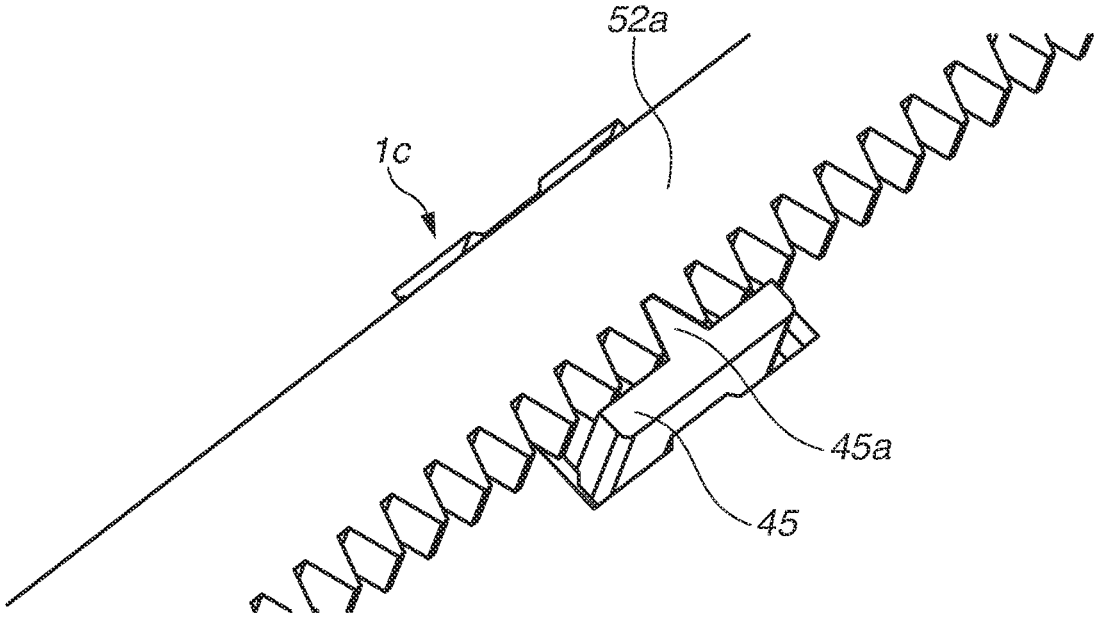
FIG. 7B is a partially enlarged perspective diagram illustrating a state where the second fixing member is attached to the supporting unit.
Figure 8A:
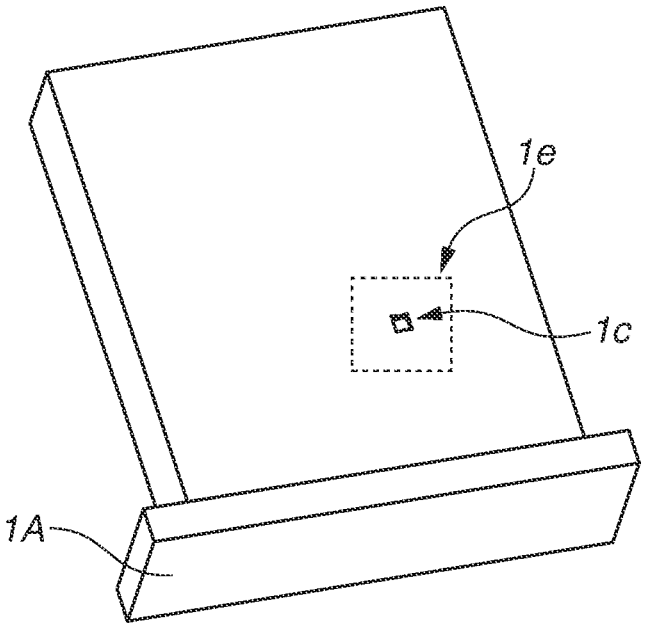
FIG. 8A is a perspective diagram illustrating the supporting unit viewed from a back side.
Figure 8B:
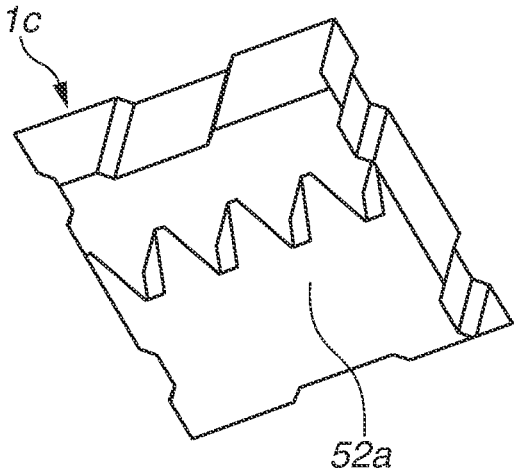
FIG. 8B is a partially enlarged diagram of the supporting unit illustrated in FIG. 8A.
Figure 9A:
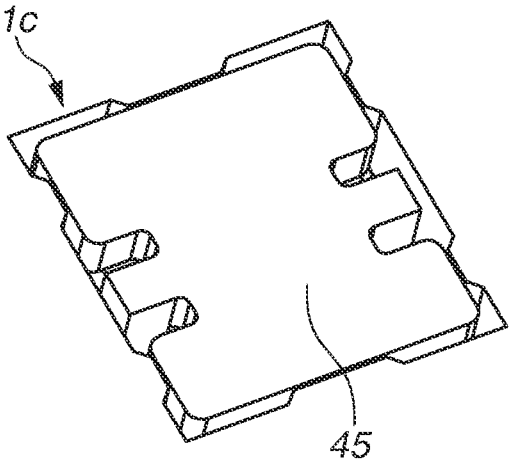
FIG. 9A is an enlarged diagram illustrating a state where the second fixing member is attached and fixed to the supporting unit illustrated in FIG. 8A.
Figure 9B:
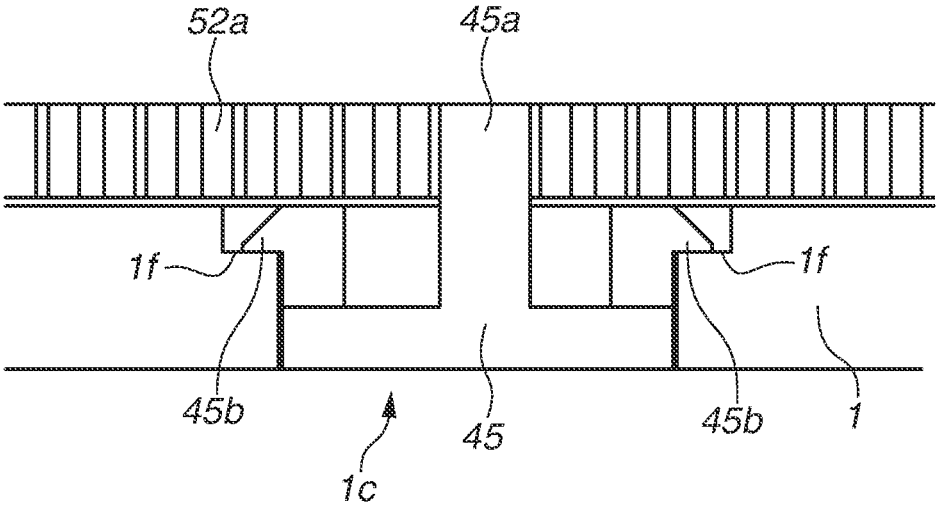
FIG. 9B is a cross-sectional diagram illustrating a state where the second fixing member is attached and fixed to the supporting unit illustrated in FIG. 8A.

FIG. 7A is a partially enlarged diagram illustrating a state where the stopper 45 is attached to the hole 1*c* of the cassette main body 1A. FIG. 7B is a perspective diagram of the partially enlarged diagram illustrating a state where the stopper 45 is attached to the hole 1*c* of the cassette main body 1A. FIG. 8A is a perspective diagram illustrating the cassette main body 1A viewed from a back side. FIG. 8B is a partially enlarged diagram of the cassette main body 1A illustrated in FIG. 8A. FIG. 9A is an enlarged diagram illustrating a state where the stopper 45 is attached and fixed to the cassette main body 1A illustrated in FIG. 8A. FIG. 9B is a cross-sectional diagram illustrating a state where the stopper 45 is attached and fixed thereto.

The stopper 45 according to the present embodiment will be described. The stopper 45 is formed of a resinous material. In the present embodiment, a color the same as a color used for the back face of the cassette main body 1A is used for the stopper 45. By using the same color, the stopper 45 becomes visually less recognizable. And thus, a chance of the user removing the stopper 45 therefrom is reduced.

Depending on the intended or predetermined use, a color different from the color of the cassette main body 1A may be used so as to make the stopper 45 be more visually recognizable. FIG. 5A is a diagram illustrating an attaching face of the stopper 45. The stopper 45 includes a claw 45*a* serving as an engaging claw. FIG. 5B is a diagram illustrating a rear face of the stopper 45. The stopper 45 includes a latching claw 45*b* serving as a latching portion.

In the present embodiment, the intermediate plate 6 illustrated in FIG. 1 need not to be removed from the cassette 1 when the stopper 45 is to be attached. As illustrated in FIG. 8A, the stopper 45 is directly attached to a hole 1*c*, which is an opening provided on the cassette main body 1A, from the rear face of the cassette main body 1A. The hole 1*c* is provided to penetrate through the cassette main body 1A. When the cassette 1 is attached to the apparatus main body 2, a side of the bottom face of the cassette main body 1A is regarded as a rear face side of the cassette 1, and a side opposite to the rear face side is regarded as a front face side thereof.

When the stopper 45 is to be attached thereto, firstly, the width regulation members 5*a* and 5*b* are moved to desired or predetermined positions. Then, the stopper 45 is attached to the cassette main body 1A from the rear face side of the cassette 1 via the hole 1*c*. In this state, as illustrated in FIGS. 7A and 7B, the claw 45*a* of the stopper 45 engages with the rack portion 52*a*, so that the movement of the rack portion 52*a* is fixed by the stopper 45. As illustrated in FIG. 9A, when the cassette main body 1A is viewed from the rear face side in a state where the stopper 45 is attached, the latching claw 45*b* of the stopper 45 enters into an inner portion of the cassette main body 1A.

Through the above-described configuration, movement of the rack portion 52*a* that engages with the claw 45*a* of the stopper 45 is regulated. In parallel, movement of the pinion gear 4 and the rack portion 52*b* cooperating with the rack portion 52*a* is also regulated, so that the width regulation members 5*a* and 5*b* are fixed. A direction from which the stopper 45 is inserted is not limited to from the rear face side of the cassette 1, and the stopper 45 may be inserted from the front face side of the cassette 1. In this case, similar to the first embodiment, the stopper 45 may be attached after removal of the intermediate plate 6. Further, in order to insert the stopper 45 into the cassette 1 without removing the intermediate plate 6, a hole having an optional shape and size may be formed on the intermediate plate 6. In a case where the hole is formed on the intermediate plate 6, a position of the intermediate plate 6 is also fixed with the stopper 45.

A rack portion which the stopper 45 engages with is not limited to the rack portion 52*a*. If the rack portions 52*a* and 52*b* cooperate with each other, the stopper 45 may engage with the rack portion 52*b*. However, more appropriate position of the hole 1*c* is determined in the cassette main body 1A, in which the sheets S are stored, depending on whether an alignment reference of the sheets S is the left edge (i.e., a side of the rack portion 52*a*) or the right edge (i.e., a side of the rack portion 52*b*). A tolerance is reduced in a case where a distance between the alignment reference of the sheets S and the fixing position of the width regulation member 5*a* or 5*b* is shorter. Accordingly, if the alignment reference of the sheets S is the left edge, the hole 1*c* should be formed so as to make the rack portion 52*a* engage with the stopper 45. If the alignment reference thereof is the right edge, the hole 1*c* should be formed so as to make the rack portion 52*b* engage with the stopper 45.

In a case where the rack portions 52*a* and 52*b* do not interlock with each other, movement of the width regulation members 5*a* and 5*b* are fixed by making both of the rack portions 52*a* and 52*b* engage with the stoppers 45. In this case, hole 1*c* serving as opening portions may be formed at corresponding two positions.

FIG. 9B is a cross-sectional diagram illustrating a state where the stopper 45 is attached to the cassette main body 1A. The stopper 45 can latch with the inner portion of the hole 1*c* of the cassette main body 1A with the latching claw 45*b* serving as a latching portion of the stopper 45. Because the latching claw 45*b* of the stopper 45 latches with a locking portion 1*f* provided on the hole 1*c* of the cassette main body 1A, an attached state of the stopper 45 with respect to the cassette main body 1A is maintained. Because the rack portion 52*a* is fixed thereby, the width regulation members 5*a* and 5*b* cannot be moved even if the user tries to move the width regulation members 5*a* and 5*b*. In the present embodiment, although the stopper 45 is attached to the cassette main body 1A through the latching claw 45*b*, an attaching method is not limited thereto. Another attaching method such as a press-fit method or an adhesive-joining method may also be used.

In the present embodiment, a grip portion is not provided on the rear face side of the stopper 45, so that the stopper 45 cannot be easily detached from the cassette main body 1A. With this configuration, the user cannot easily detach the stopper 45. However, the stopper 45 may desirably be detached easily with respect to the user who would like to fix the width regulation members 5*a* and 5*b* only at a time of transportation of the image forming apparatus 100. In this case, for example, a grip portion protruding from the hole 1*c* may be provided on the rear face of the stopper 45, so that the user can easily detach the stopper 45 from the cassette main body 1A by using the grip portion.

Figure 10A:
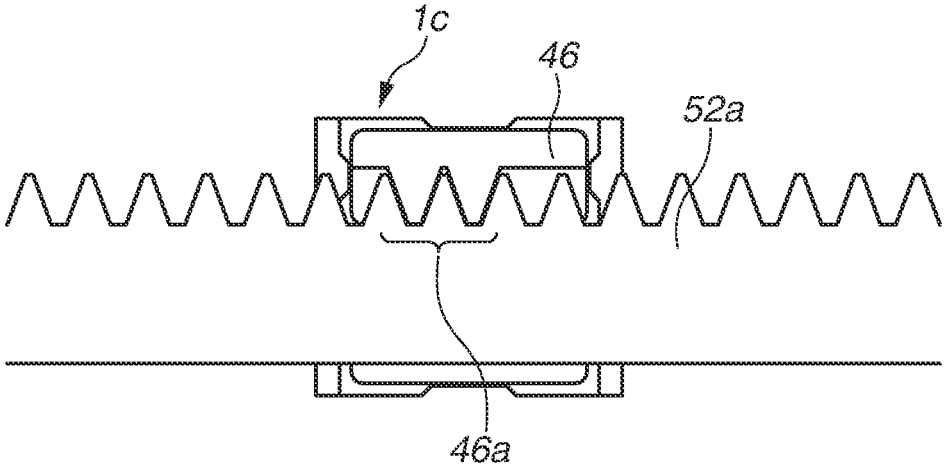
FIGS. 10A and 10B are enlarged diagrams illustrating other examples of the second fixing member.
Figure 10B:
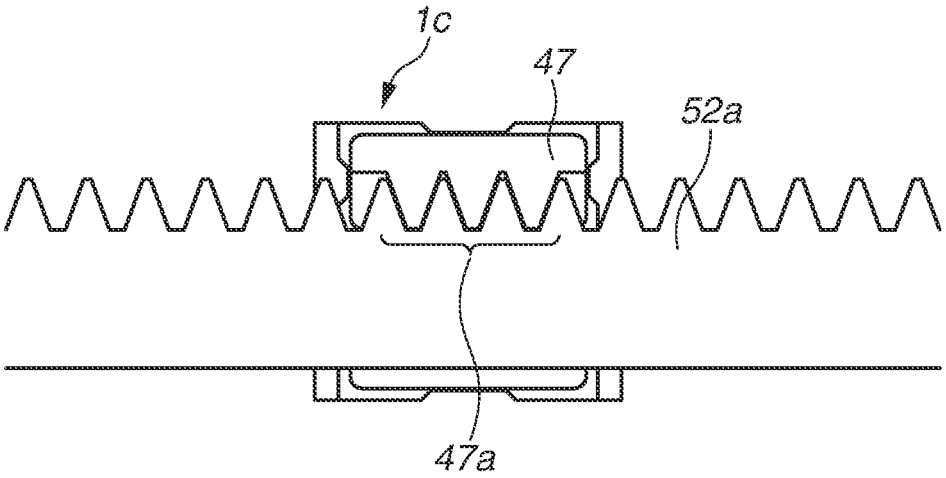

The stopper 45 may be formed into another shape. For example, as illustrated in FIGS. 10A and 10B, a plurality of engaging claws as fixing portions may be arranged on the stopper 46 and 47 serving as the second fixing member. The stopper 46 illustrated in FIG. 10A includes two engaging claws 46*a*. The stopper 47 illustrated in FIG. 10B includes three engaging claws 47*a*. As described above, although the second fixing member that engages with the rack portion 52*a* may include at least one engaging claw, the number of engaging claws may be more than one. Further, if the number of engaging claws is greater, strength of the engaging portion with respect to the rack portion 52*a* will be increased and thus the force for fixing and retaining the width regulation members 5*a* and 5*b* is improved.

Figure 11A:
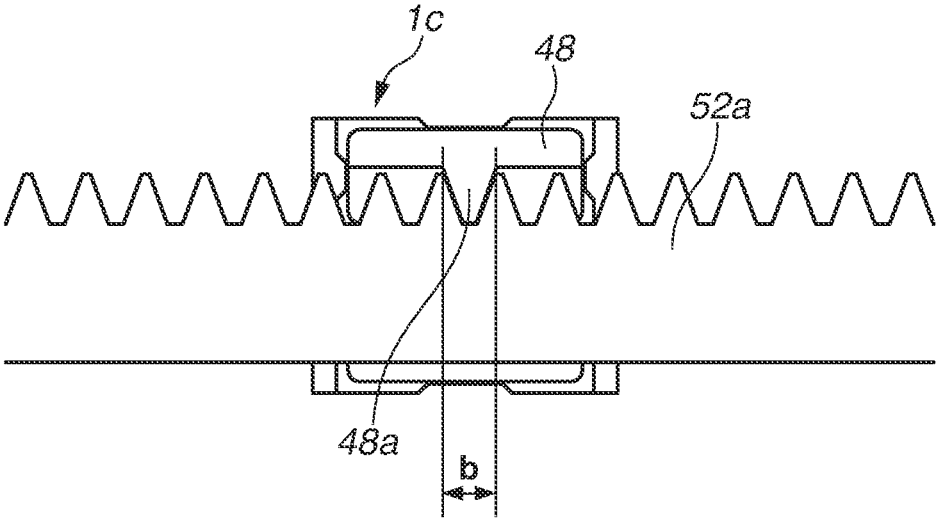
FIG. 11A is an enlarged diagram illustrating an engaging claw included in the second fixing member.

In a case where a size of the sheet regulated by the width regulation members 5*a* and 5*b* is determined when the width regulation members 5*a* and 5*b* are used in a fixed state, a width of the engaging claw may be specified. FIG. 11A is an enlarged diagram illustrating a stopper 48 as the second fixing member and an engaging claw 48*a* included in the stopper 48. With respect to the stopper 48, a size of a width b of the engaging claw 48*a* is specified. Specifically, the width b is specified as a value by which 6 mm is dividable, e.g., 3 mm, 2 mm, 1 mm, or 0.5 mm.

The "6 mm" above represents a difference between the width 216 mm of Letter size sheet and the width 210 mm of A4 size sheet. By specifying the value of the width b of the engaging claw 48*a* as an interval by which the difference 6 mm is dividable, the stopper 48 can fix the width regulation members 5*a* and 5*b* while minimizing a gap arising when the sheets of respective sizes, i.e., Letter size and A4 size, are fixed.

Since the width b is specified with respect to the member that regulates the widths of Letter size sheets and A4 size sheets conveyed in a portrait orientation, the width b is specified as a value by which the difference 6 mm is dividable. However, if fixation of sheets of different types having the widths other than the above-described widths is to be achieved, the value of width b has to be specified as a value by which a difference of sheets of all types regarded as fixation targets is dividable. By satisfying the above-described condition, the stopper 48 can manage fixation of sheets of greater variation. Similarly, a width of the claw of the rack portion 52*a* has to be specified in accordance with the size of the width b.

Figure 11B:
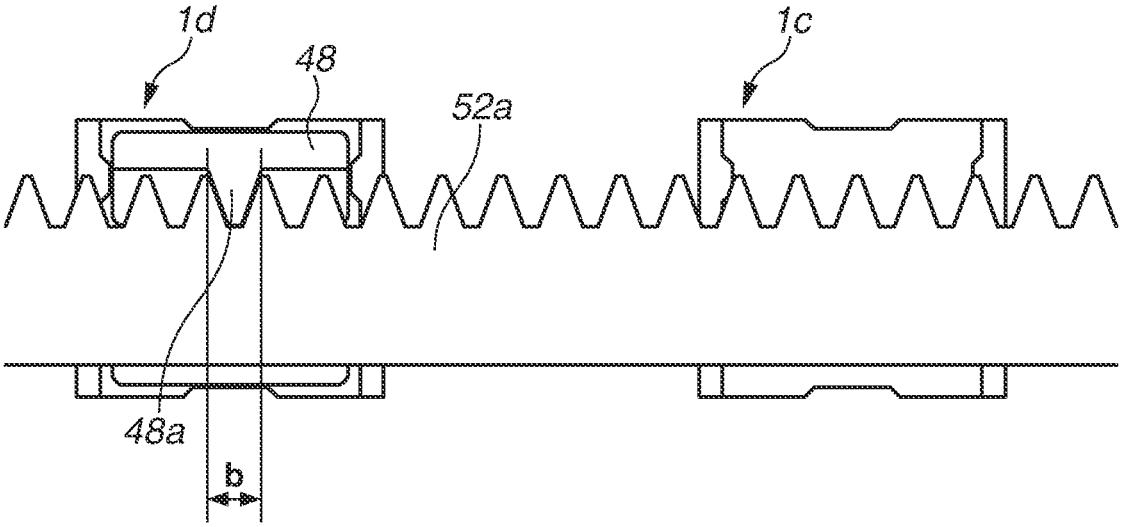
FIG. 11B is an enlarged diagram illustrating the second fixing member engaging with a moving member at a hole 1*d* of the supporting unit different from a hole 1*c* of the supporting unit.

FIG. 11B is an enlarged diagram illustrating the stopper 48 which engages with the rack portion 52*a* at a hole 1*d* of the cassette main body 1A, which is different from the hole 1*c* of the cassette main body 1A. The stopper 48 is inserted into two places, the holes 1*c* and 1*d*, of the cassette main body 1A. Thus, a degree of freedom in fixing the width regulation members 5*a* and 5*b* is improved. If a phase of hole position with respect to the rack portion 52*a* is shifted between the holes 1*c* and 1*d* of the cassette main body 1A, a fixing unit for engaging with any one of the holes 1*c* and 1*d* of the cassette main body 1A is provided. In particular, by shifting the phase of hole positions of the hole 1*c* and the hole 1*d* of the cassette main body 1A by half a pitch of the claw with respect to the rack portion 52*a*, a degree of freedom is improved efficiently, so that sheets of different types with greater variation of widths are managed thereby. Further, the stopper 48 is inserted to the hole 1*c* of the cassette main body 1A when Letter size sheet is to be fixed, and the stopper 48 is inserted to the hole 1*d* of the cassette main body 1A when A4 size sheet is to be fixed. As described above, usability is improved by changing the insertion position. Further, the stopper 48 can engage with the rack portion 52*b* through the hole 1*d* of the cassette main body 1A instead of engaging with the rack portion 52*a*.

Figure 12:
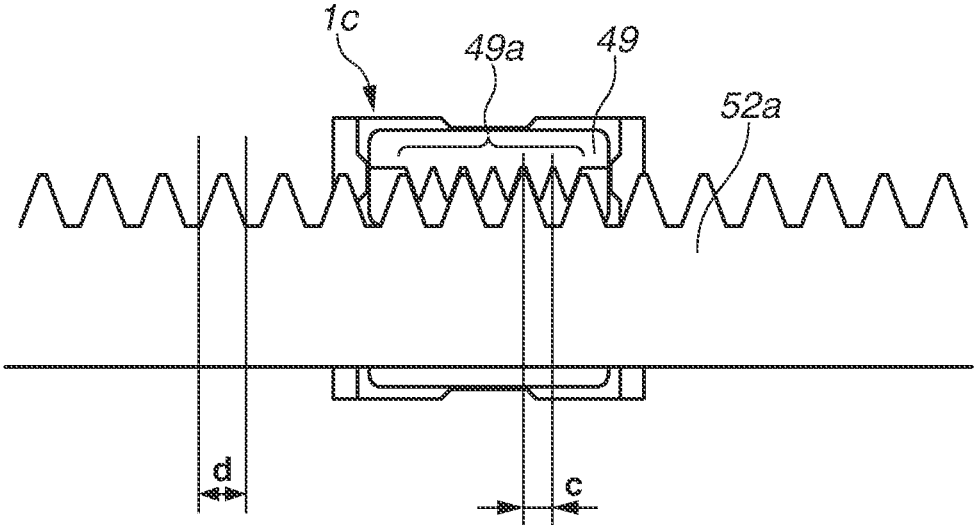
FIG. 12 is an enlarged diagram illustrating another example of the second fixing member.

FIG. 12 is a partially enlarged diagram illustrating a stopper 49 serving as a second fixing member which includes an engaging claw having a width shorter than a width (i.e., pitch distance) of a rack gear of the rack portion 52*a* serving as a portion with which the engaging claw engages. A width c of the stopper 49 is smaller than the width d of the claw of the rack portion 52*a*, and the width c is a value by which the width d is dividable. With this configuration, the stopper 49 can fix the rack portion 52*a* while minimizing the gap when the engaging claw engages therewith. However, if the width c of the claw 49*a* of the stopper 49 is selected to be too small, an engaging amount of the claw is also reduced, so that the claw may be disengaged easily. Accordingly, a width that is half the width d of the claw of the rack portion 52*a*, which serves as a portion with which the engaging claw engages, should be appropriate for the width c of the claw 49*a* of the stopper 49.

Providing a plurality of claws 49*a* on the stopper 49 compensates lowering of strength caused by reduction in size of the claw 49*a*. Further, a relationship between the claw 49*a* of the stopper 49 and the claw of the rack portion 52*a* may be reversed. In other words, the width d of the claw of the rack portion 52*a* may be specified as a value by which the width c of the claw 49*a* of the stopper 49 is dividable.

A housing portion dedicated for housing the stopper 45 (or the stopper 46, 47, 48, or 49) may be provided on the cassette main body 1A. In this case, the stopper 45 is not attached to the cassette main body 1A, and the stopper 45 is taken out from the housing portion and used when the width regulation members 5*a* and 5*b* are fixed.

In the present embodiment, although a method for fixing the width regulation members 5*a* and 5*b* has been described, the same configuration is used not only for the width regulation member but also for the rear-edge regulation member.

Further, a combination use of the first fixing member 41 in the first embodiment and the second fixing member in the present embodiment is also possible. In the configuration described in the first embodiment, since the first fixing member 41 is not exposed externally, the user has to remove the intermediate plate 6 in order to check whether the first fixing member 41 is in use. In the combination use, the user can visually recognize the stopper 45 if the hole 1*c* is formed on the rear face side of the cassette main body 1A. The user can recognize that the width regulation members 5*a* and 5*b* are fixed by visually recognizing the stopper 45, so that the user need not to remove the intermediate plate 6 to check the stopper 45.

As described above, in the present embodiment, the width regulation members 5*a* and 5*b* are fixed by utilizing the constituent elements included in the moving unit 20. Therefore, the width regulation members 5*a* and 5*b* are fixed at optional positions without using the screws and screw holes, which is discussed in Japanese Patent Application Laid-Open No. 2016-113300. The optional positions may be, for example, the positions corresponding to a sheet in a non-standard size.

According to the present embodiment, by attaching the stopper 45 to the hole 1*c* formed on the cassette main body 1A, it is possible to provide a sheet storage device in which the width regulation members 5*a* and 5*b* are fixed more easily than the conventional configuration.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Applications No. 2018-068253, filed Mar. 30, 2018, and No. 2018-204524, filed Oct. 30, 2018, which are hereby incorporated by reference herein in their entirety.

What is claimed is:

1. A sheet storage device for storing sheets, the sheet storage device comprising:

a stacking member on which the sheets are to be stacked;

a main body configured to support the stacking member;

a first regulating member configured to regulate one end side of each of the sheets with respect to a width direction intersecting a conveyance direction of the sheets stacked on the stacking member;

a second regulating member configured to regulate the other end side of each of the sheets with respect to the width direction;

a first moving member having a first rack portion and configured to move integrally with the first regulating member;

a second moving member having a second rack portion and configured to move integrally with the second regulating member; and a fixing member provided with engaging portions engaged with the first rack portion and the second rack portion and provided with regulating portions configured to regulate movements of the first rack portion and the second rack portion, wherein the regulating portions are located adjacent to the respective engaging portions with respect to a direction of rotation of the fixing member, wherein the fixing member is arranged between the first moving member and the second moving member, wherein the first moving member and the second moving member are prevented from moving in the width direction by the regulating portions, and wherein movements of the first moving member and the second moving member are regulated by abutting the regulating portions on the first rack portion and the second rack portion.

2. The sheet storage device according to claim 1, wherein the stacking member is arranged to cover the first moving member and the second moving member in a first direction, and wherein the stacking member completely covers the fixing member.

3. An image forming apparatus comprising:

an image forming unit configured to form a toner image;

a feeding member configured to feed a sheet to the image forming unit; and the sheet storage device according to claim 1, configured to store the sheet fed by the feeding member.

4. A sheet storage device for storing a sheet, the sheet storage device comprising:

a stacking member on which sheets are to be stacked;

a main body configured to support the stacking member;

a regulation unit configured to regulate a position of an edge portion of the sheets; and a moving unit configured to move the regulation unit, wherein the moving unit includes a moving member movable in a predetermined direction and a rotation member that is in contact with the moving member and rotatably arranged on the main body, wherein the moving member moves in the predetermined direction by rotation of the rotation member, wherein the main body includes a bottom face portion constituting a bottom face, and the bottom face portion includes a penetrated opening, wherein a fixing member is attached to the main body in a state where the fixing member engages with the moving member via the penetrated opening, and wherein the movement of the moving member in the predetermined direction is regulated by the fixing member in the state where the fixing member engages with the moving member via the penetrated opening.

5. The sheet storage device according to claim 4, wherein the fixing member includes a latching portion configured to be latched with the bottom face portion.

6. The sheet storage device according to claim 5, wherein the latching portion does not expose to an exterior portion in a state where the fixing member is inserted to the penetrated opening.

7. The sheet storage device according to claim 5, wherein the rotation member is a pinion gear.

8. The sheet storage device according to claim 7, wherein the moving member is a first moving member having a first rack gear engaging with the pinion gear and is moved in a first direction through rotation of the pinion gear.

9. The sheet storage device according to claim 8, further comprising a second moving member configured to move in a second direction opposite to the first direction and having a second rack gear engaging with the pinion gear, wherein, in a case where the fixing member is attached to the main body, movement in a parallel direction of the second moving member is regulated by the fixing member.

10. The sheet storage device according to claim 9, wherein the fixing member includes an engaging claw inserted into a space between claws of the first rack gear and configured to engage with the first rack gear.

11. The sheet storage device according to claim 10, wherein a width dimension of the engaging claw is shorter than a width dimension of the first rack gear.

12. An image forming apparatus comprising:

an image forming unit configured to form a toner image;

a feeding member configured to feed a sheet to the image forming unit; and the sheet storage device according to claim 4, configured to store the sheet fed by the feeding member.

* * * * *